US006098678A

United States Patent [19]

Shears

[11] Patent Number: 6,098,678

[45] Date of Patent: Aug. 8, 2000

[54] CLEANER FUNNEL

[76] Inventor: Randall C. Shears, P.O. Box 2851, Elkins, W. Va. 26241

[21] Appl. No.: 09/346,191

[22] Filed: Jul. 1, 1999

Related U.S. Application Data

[60] Provisional application No. 60/091,523, Jul. 2, 1998.

[51] Int. Cl.[7] ..... B65B 1/04

[52] U.S. Cl. ..... 141/331; 141/339; 141/340

[58] Field of Search ..... 141/331–345

[56] References Cited

U.S. PATENT DOCUMENTS

| | | | |
|---|---|---|---|
| 3,899,012 | 8/1975 | Sather | 141/331 |
| 4,261,353 | 4/1981 | Bartels | 128/200.11 |
| 4,286,634 | 9/1981 | Wisner | 141/95 |
| 4,703,867 | 11/1987 | Schoenhard | 220/85 F |
| 4,706,719 | 11/1987 | Eversdijk | 141/98 |
| 4,706,720 | 11/1987 | Pattison et al. | 141/337 |
| 4,856,568 | 8/1989 | Murphy et al. | 141/337 |
| 4,886,182 | 12/1989 | Fedelem et al. | 220/85 F |
| 4,896,746 | 1/1990 | Desjardins | 184/92 |
| 5,018,559 | 5/1991 | Branan | 141/339 |
| 5,033,521 | 7/1991 | Martin | 141/337 |
| 5,316,059 | 5/1994 | Lahnan | 141/340 |
| 5,402,835 | 4/1995 | Middleton | 141/331 |
| 5,472,025 | 12/1995 | Conrad et al. | 141/332 |

*Primary Examiner*—Steven O. Douglas
*Attorney, Agent, or Firm*—Steptoe & Johnson

[57] ABSTRACT

A cleaner funnel is provided having a lid for closing the inlet end and a plurality of accessories that are removably attachable to the outlet end of the funnel. One accessory is a reducer that reduces the diameter of the outlet end hole in order to service containers having smaller opening widths. A second accessory is a cap-reservoir for closing off the outlet end hole of the funnel and collecting and storing any remnant fluid in the funnel body. The accessories are stored on receptacles located on the exterior of the funnel which makes them clean during storage, as well as, readily and easily available for use. Further, the funnel remains clean and ensures the integrity of the liquid being transferred via the funnel by use of the lid, the cap-reservoir and the external storage of the accessories.

17 Claims, 14 Drawing Sheets

FIG. 6
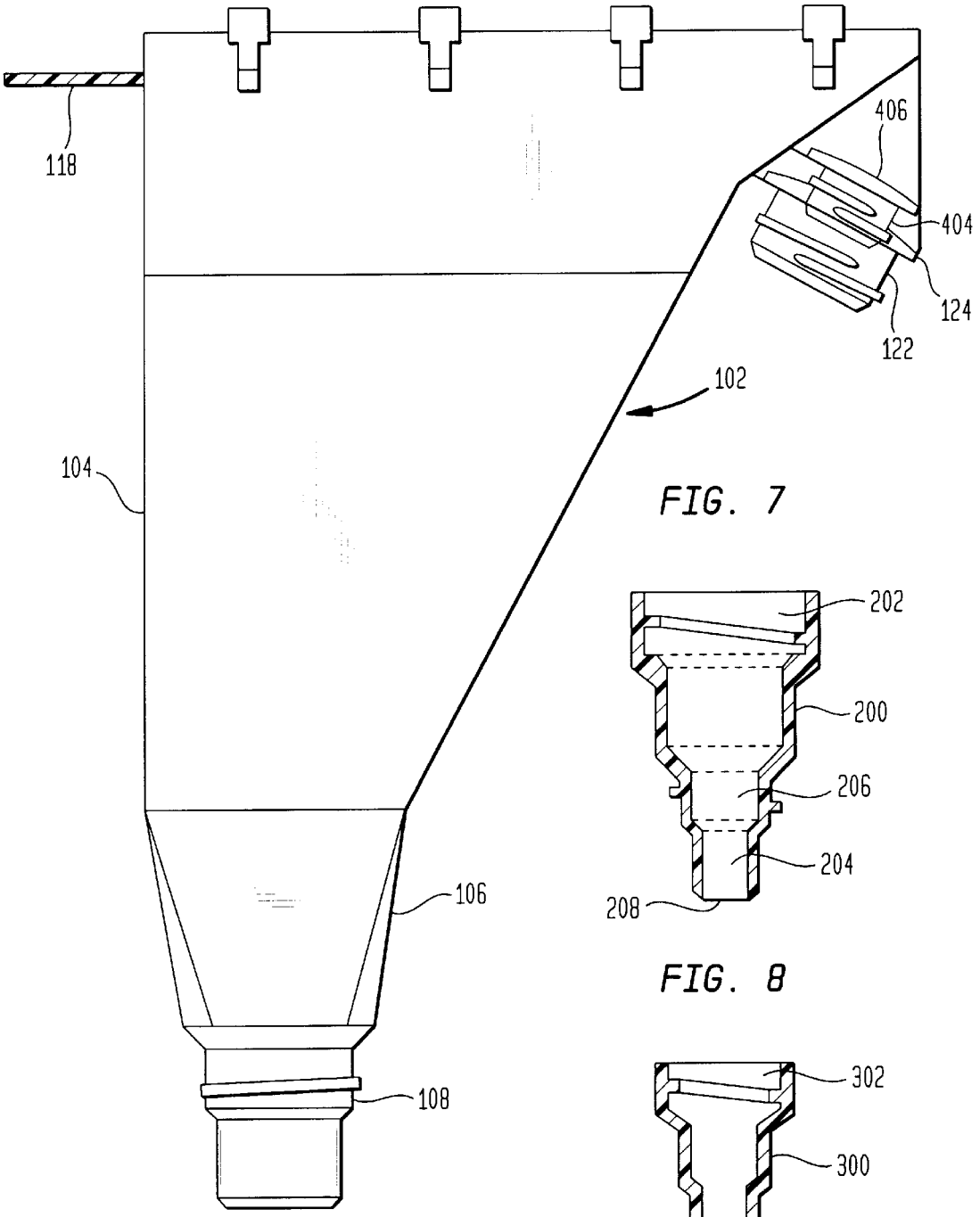
FIG. 7
FIG. 8
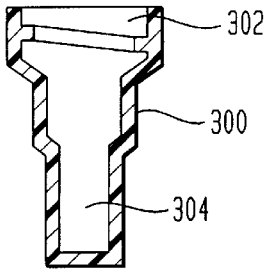

CLEANER FUNNEL

CROSS-REFERENCE TO RELATED APPLICATIONS

This application claims the benefit of application Ser. No. 60/091,523, filed Jul. 2, 1998.

BACKGROUND OF THE INVENTION

1. Field of the Invention

This invention relates to funnels, and more specifically to an environmentally clean funnel that provides a means for maintaining cleanliness and versatility of the funnel and all attachments thereto.

2. Related Art

It is well known in the art that funnels are used as a means for transferring liquids or fluids between various sized containers without spills. However, the disadvantage with conventional funnels is that they do not adapt to various sized containers in a manner that permits for the clean transfer of liquids or fluids. Although funnels having attachments of varying widths are available, often there is no means by which the attachments are easily and/or cleanly stored such that the funnel and attachments can be stored without needing cleaning prior to their next use. If such funnels do provide a means for securing attachments, it is often done by placing the attachments into the funnel itself. As a result, the attachments become dirty or covered with residual fluid in the funnel, and often such attachments introduce dirt or other contaminants into the funnel. do not have to be cleaned prior to use.

In addition, users often find that conventional funnels are inadequate for transferring thick fluids or for filling containers having wide openings. As a result, most users will cut off the outlet end of the funnel at a point where the diameter of the outlet end is of a sufficient width so as to make the funnel usable with thick fluids or when filling a containers with wide openings. This is extremely inconvenient because once a funnel is altered, it can never return to its original design and function properly with thinner fluids or when filling containers having small openings.

Therefore, there is a need for a funnel that can easily adapt its outlet opening to varying widths.

U.S. Pat. No. 4,706,719 to A. Eversdijk (the '719 Patent) discloses a funnel that purports to adapt to various sized containers by means of attachments as well as can be stored without cleaning and without danger of soiling. However, there are several disadvantages with the '719 Patent. First, the '719 Patent teaches a means for housing funnel attachments by placing the attachments inside a funnel lid. It also causes the person changing the oil to waste time opening and closing an unnecessary compartment. Furthermore, this additional compartment in the lid hinders the pouring of liquids or fluids into the funnel because the lid/compartment combination remains connected to the funnel, thereby gets in the user's way when using the funnel. This lid/compartment also prevents a user from using the funnel in small places due to its increased space requirement on the one side where the lid/compartment is connected. There is also an added manufacturing cost to the funnel because of the separate compartment requirement. Therefore, the '719 Patent does not solve the problem of providing a convenient means for securing the attachments because it requires the necessity of another compartment to the funnel to store the accessories.

Therefore, there is a need for a funnel that does not require an additional compartment to store accessories.

Another disadvantage of the '719 Patent is that the spout has folds which is used for the discharge of remnants of liquid and for storage in that the spout can be compressed and bent when not in use. In very cold weather, the spout of the '719 Patent will become stiff and rigid to the point of not straightening from its stored position, and even lead to cracking and breaking.

Therefore, there is a need for a funnel having a spout that does use folds or other means for compression and bending, such that the funnel can be used in freezing weather. not in use. In very cold weather, the spout of the '719 Patent will become stiff and rigid to the point of not straightening from its stored position, and even lead to cracking and breaking.

Therefore, there is a need for a funnel having a spout that does use folds or other means for compression and bending, such that the funnel can be used in freezing weather.

Another disadvantage with the '719 Patent pertains to its means for collecting and disposing of remnant liquid. A collecting holder is used to store any such remnant liquid; however, this means of collection is very cumbersome and messy. Specifically, the use of a collection holder requires additional storage space, thereby making the funnel larger than necessary and cumbersome to store and use. In addition, because the remnant liquid drains from the spout into the spout holder then into the collecting holder, the external surface of the spout and the spout holder would be covered in the remnant liquid and any dirt that was on the spout.

Therefore, there is a need for a funnel that provides a compact and efficient means for collecting and storing any remnant liquid in the funnel after the funnel's use, wherein the funnel does not become soiled during such collection and storage.

SUMMARY OF THE INVENTION

The present invention solves the problems associated with conventional funnels by providing a funnel body having an inlet end and an outlet end wherein the inlet end opening and the outlet end opening can be covered to ensure that the funnel body remains clean and free of dirt and contaminants during storage. Thus, during a subsequent use, the funnel will not transmit dirt or other contaminants with the liquid being transferred via the funnel.

The funnel of the present invention also provides several important accessories that are removably attachable to the outlet end of the funnel. First, the present invention includes a reducer that is used to reduce the diameter of the funnel's outlet end opening hole size in order to allow the funnel to efficiently access small container openings for receiving a liquid. The advantage of using a reducer is that it provides the means by which the single funnel can service various sized containers, thereby eliminating the need for a user to have multiple sized funnels.

A second accessory is a cap-reservoir that is removably attachable to the outlet end of the reducer. The cap-reservoir provides a closed storage compartment for remnant fluids in the funnel body. Therefore, a user does not have to worry about a stored funnel draining or dripping its remnant fluids onto other items the funnel comes into contact with. In operation, when the funnel is stored in an upright position, any remnant fluids in the funnel body and, if used, the reducer, will drain into the cap-reservoir. Therefore, to dispose of the remnant fluids, a user merely has to remove the cap-reservoir and dump out the excess fluid. The advantage of the cap-reservoir of the present invention is that no other part of the funnel or its accessories comes in contact with the remnant fluid and therefore remains clean.

The funnel of the present invention also provides a means for storing attachments to the exterior of the funnel which maintains the integrity and cleanliness of the funnel while ensuring that the attachments are readily and easily accessible for use. Specifically, the present invention provides multiple receptacles on one side of the funnel onto which the reducer and cap-reservoir accessories can be removable attached for storage. This design ensures that the user always has immediate access to the accessories, that the accessories remain with the funnel at all times, and that the accessories do not interfere with the operation of the funnel. Furthermore, such a design does not require the added expense and necessity of a separate compartment and does not contaminate the inside of the funnel.

The funnel provides several features that facilitate the use and operation of the funnel. For example, the funnel includes a hanger clip for hanging the funnel in an up-right position during storage. The funnel also includes a support fin that a user holds to support and balance the funnel while pouring fluids in the inlet end of the funnel.

The present invention also provides a simple and economical configuration that is adaptable to funnels having different shaped inlet ends, e.g., round, square, rectangular, and various lengths and shapes of outlet ends (spouts) that will not require any changes in the reducer, cap-reservoir, or their respective receptacles, as long as the outlet end opening hole size of the funnel spout is kept uniform.

BRIEF DESCRIPTION OF THE FIGURES

The present invention is described with reference to the accompanying drawing. In the drawing, like reference numbers indicate identical or functionally similar elements. Additionally, the left-most digit of a reference number identifies the drawing in which the reference number first appears.

FIG. 6 is a planar view of the back of the funnel;

FIG. 7 is a cross sectional view of the reducer;

FIG. 8 is a cross sectional view of the cap-reservoir;

DETAILED DESCRIPTION OF THE PREFERRED EMBODIMENTS

Figures 1, 2, 3:
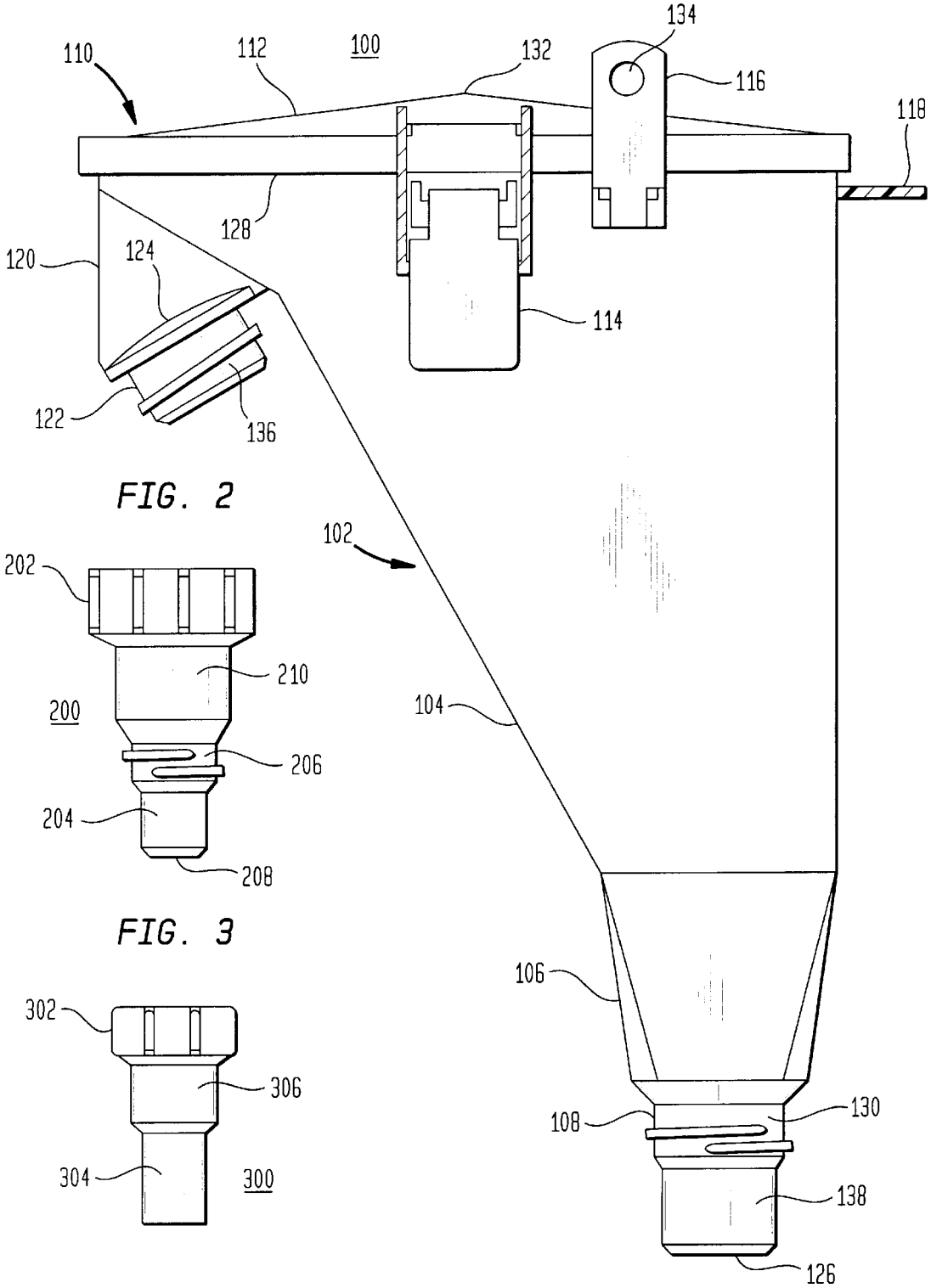
FIG. 1 is a planar front view of a funnel of the present invention.
FIG. 2 is a planar side view of a reducer of the present invention.
FIG. 3 is a planar side view of a cap-reservoir of the present invention.

FIG. 1 is a planar front view of a funnel 100 of the present invention. The funnel 100 comprises a funnel body 102 having an inlet end 104 with an inlet end hole 128, a funnel neck 106, and an outlet end 108 with an outlet end hole 126, integrally combined into a single product. In the preferred embodiment, the inlet end 104 of the funnel body 102 is square in shape with four (4) sides, a front, a back, a left side and a right side, wherein the outlet end 108 is offset to one side of the funnel body 102. That is, the outlet end 108 tapers down to the right front bottom corner of the funnel body 102 away from a center axis of the funnel. Tapering the funnel body 102 in such an offset manner makes it easier to transfer fluids into a container that is close to an obstruction.

In the preferred embodiment, the outlet end 108 of the preferred embodiment has a large male threaded connector 130 to accept various accessories. The male threaded connector 130 reduces down at a 45° bevel to a smaller threaded section that has a 45° bevel at the end of it leading to a ⅝ inch outlet end hole 126. In the preferred embodiment, the two 45° beveled surfaces are free of deformities to tighten against two corresponding 45° beveled surfaces inside an accessory's female threaded receiver to produce a seal between the funnel body 102 and an accessory. The means for attaching an accessory to the outlet end 108 of the funnel body 102 is described in these terms of a male threaded connector and a female threaded receiver for convenience purpose only. It would be readily apparent to one of ordinary skill in the relevant art to use a comparable means for attaching, e.g., using well-known snap-on devices or push and turn seal systems.

FIGS. 2 and 3 are planar side views of two accessories of the present invention. FIG. 2 shows a reducer 200 which provides a means for reducing the diameter of the outlet end hole 126 of the funnel 100, thereby allowing the funnel 100 to adapt to different needs and to containers of varying diameter openings. If a thick liquid is being used or a wide opening container is being filled, a user may remove the reducer 200 from the outlet end 108 of the funnel 100 and use a wider outlet end hole 126. In contrast, if a thinner liquid is being used or a smaller opening container is being filled, a user may attach the reducer 200 to the outlet end 108 of the funnel 100 to have a smaller outlet end hole 126.

In the preferred embodiment, the reducer 200 comprises a threaded female receiver 202 for attaching to the threaded male connector 130 of the outlet end 108, a threaded male connector 206 for receiving other accessories of the present invention, and an outlet end 204 having an outlet end hole 208 that is narrower than the outlet end hole 126 of the funnel 100. The means for attaching the reducer 200 to the funnel body 102 and the means for the reducer 200 to receive additional accessories is described in greater detail below.

FIG. 3 shows a cap-reservoir 300 of the present invention which is used as a means for closing off the outlet end 108 of the funnel 100 and for receiving and storing any remnant fluid in the funnel body 102. In the preferred embodiment, the cap-reservoir 300 comprises a threaded female connector 302 for attaching to the threaded male connector 204 of the reducer 200 and a reservoir 304 for closing off the outlet end 108 of the funnel 100 and for storing any remnant fluid in the funnel body 102. The cap-reservoir 300 is described in terms of attaching to the reducer 200 for convenience purpose only. It would be readily apparent for one of ordinary skill in the relevant art(s) to design and manufacture a cap-reservoir 300 of the present invention that attached directly to the outlet end 108 of the funnel body 102. The means for attaching the cap-reservoir 300 to the reducer 200 is described in greater detail below.

Returning to FIG. 1, the funnel 100 of the present invention also comprises a means for attaching and storing accessories on the exterior of the funnel body 102. Such a means for storing ensures that accessories are always readily available to the user while maintaining the cleanliness of the accessories and funnel 100. Readily visible on FIG. 1 is a reducer receptacle 122, which in the preferred embodiment, comprises a threaded male connector 136 for receiving and storing the reducer 200 when not in use on the outlet end 108 of the funnel body 102. The reducer receptacle 122 is attached to the exterior of the funnel body 102 by a reducer receptacle support 120, but this is for convenience purpose only. It would be readily apparent for one of ordinary skill in the relevant art to design and attach a reducer receptacle 122 to the funnel body 102 by any other comparable means. Similar to the reducer receptacle 122, but not visible on FIG. 1, is a cap resistor receptacle which is described in greater detail below.

The funnel 100 of the present invention also comprises a lid 110 having a top section 112 that forms a peak 132 in its center. In the preferred embodiment, the lid 110 starts ¼ inches in from the left and right sides of the inlet end hole 128 of the funnel body 102 and comes to a peak 132 that is ¼ inch high in the center of the lid 110. This slope in the lid 110 prevents the lid 110 from warping and not sealing the entire inlet end hole 128 of the funnel body 102. In the preferred embodiment, the sides of the lid 110 are also ¼ inch high except for the back side of the funnel body 102 wherein the side of the lid 110 is only ⅛ inch high so that it does not interfere with the opening and closing of the lid 110. Also in the preferred embodiment, the lid 110 comprises a seal, as described in greater detail below, positioned on the underside of the lid 110. The seal is made of rubber to prevent the absorption of oil or other liquid while maintaining a uniform thickness for closing off the inlet end hole 128. On the top front of the lid 110 is a latch catch 114, or fasten latch, for securing the lid 110 closed. The lid 110 is also hinged far enough back to allow adequate clearance for the lid 110 to lay straight down when opened. The lid 110 of the present invention is described in these terms for convenience purpose only. It would be readily apparent for one of ordinary skill in the relevant art(s) to design and manufacture a comparable lid, e.g., a lid having a different means for pivotally or removably attaching to the inlet end hole 128 of the funnel body 102.

The preferred embodiment of the funnel 100 of the present invention also comprises a hanger clip 116 and a support fin 118. The hanger clip 116 is hinged to the funnel body 102 as a means for storing the funnel 100 when not in use. For example, the hanger clip 116 is a flat plate pivotally secured to the inlet end 14 of the funnel body 102 to allow the funnel 100 to move when it is hung from a nail so that the means of storing the funnel 100 will not put undue pressure on the funnel body 102. Pivotally connecting the hanger clip 116 also prevents deformation of the funnel body 102 during storage. In the preferred embodiment, the hanger clip 116 has a 7/32 inch hole 134 that is ⅛ inch from the top section 112 of the lid 110 of the funnel 100 and is used to hang the funnel body 102. The support fin 118 of the present invention of the funnel body 102 provides a place for a user to hold the funnel body 102 while pouring fluids into the inlet end 104 of the funnel body 102. In the preferred embodiment, the support fin 118 is located on the right side of the funnel body 102. However, it should be understood that it would be readily apparent to one skilled in the art to change the positioning of the support fin 118, or any other component of the funnel 100, to accommodate every individual.

Figure 4:
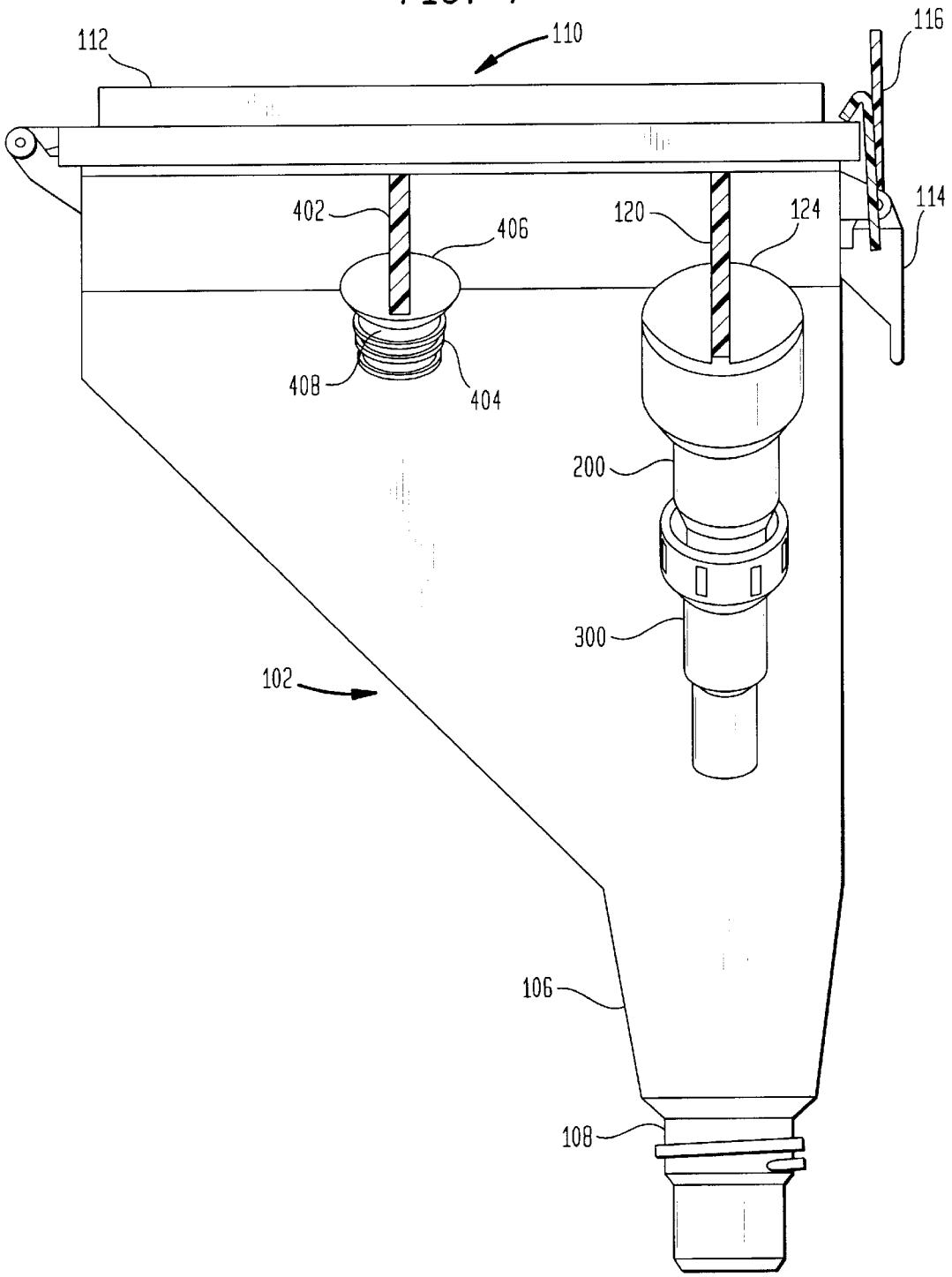
FIG. 4 is a planar view of the left side of the funnel with its accessories stored on a reducer receptacle.

FIG. 4 is a planar view of the left side of the funnel with the preferred accessories stored together on a reducer receptacle 122. As discussed briefly above, there are two preferred accessories for the funnel 100 of the present invention: a reducer 200 and a cap-reservoir 300. Similar to the reducer receptacle 122, the funnel body 102 also comprises a cap-reservoir receptacle 404 for receiving and storing a cap-reservoir 300 when not in use. Specifically, the cap-reservoir receptacle 404, which in the preferred embodiment, comprises a threaded male connector 408 for receiving and storing the cap-reservoir 300 when not in use on the outlet end 108 of the funnel body 102. The cap-receptacle reducer receptacle 404 is attached to the exterior of the funnel body 102 by a cap-reservoir receptacle support 402 and has a cap-reservoir cap 406 located above the threaded male connector 408, but this is for convenience purpose only. It would be readily apparent for one of ordinary skill in the relevant art to design and attach a cap-reservoir receptacle 404 to the funnel body 102 by any other comparable means.

In the preferred embodiment, the reducer receptacle support 120 and the cap-reservoir support 402 are ⅛ inches thick to provide maximum support for the reducer receptacle 122 and the cap-reservoir receptacle 404. Furthermore, the reducer receptacle cap 124 and the cap-reservoir receptacle cap 406 are convex shaped to their tops, but this is for convenience purpose only.

Under the reducer receptacle cap 124 is a threaded male connector 136 to accept the reducer 200. The threaded male connector 136 under the reducer receptacle cap 124 has a 45° beveled surface at its end that, in the preferred embodiment, is free of deformities on its surface. The threaded male connector 136 of the reducer receptacle 122 tightens against the 45° beveled surface inside the threaded female receiver 202 of the reducer 200 to produce a seal. The length of the threaded male connector 136 in the preferred embodiment is 0.020 inches longer than the distance from the top of the reducer 200 to its first 45° beveled surface inside the threader female receiver 202. This allows the two 45° surfaces to tighten up against each other while keeping the gap between the reducer receptacle cap 124 and the threaded female receiver 202 of the reducer 200 minimized. By minimizing the gap between the reducer receptacle cap 124 and the threaded female receiver 202 of the reducer 200 dirt will be kept out.

The threaded male connector 408 under the cap-reservoir receptacle cap 406 accepts the cap-reservoir 300. In the preferred embodiment and as similar to the reducer receptacle 122, the threaded male connector 408 has a 45° beveled surface at its end that should be free of deformities to produce a seal when it tightens against the first 45° beveled surface inside the threaded female receiver 302 of the cap-reservoir 300. The length of the threaded male connector 408 is 0.020 inches longer than the distance between the top of the threaded female receiver 302 of the cap-reservoir 300 and its first 45° surface inside the threaded female receiver 302 to allow the two 45° beveled surfaces to tighten up against each other while keeping the gap between the cap-reservoir receptacle cap 406 and the end of the threaded female receiver 302 of the cap-reservoir 300 to a minimum, thereby keeping dirt out.

The inside of the threaded female receiver 202 of the reducer 200 has a threaded section that is 0.020 inches greater in diameter than the outside diameter of the threaded male connector 130 of the outlet end 108 of the funnel body 102 and of the threaded male connector 136 of the reducer receptacle 122. This allows the reducer 200 to screw onto either the outlet end 108 of the funnel body 102 or the reducer receptacle 122. In addition, the threaded female receiver 202 in the reducer 200 has a 45° beveled surface that is free of deformities. This threaded female receiver 202 tightens against either the 45° beveled surface on the reducer receptacle 122 or the upper 45° beveled surface on the outlet end 108 of the funnel body 108 to produce a seal. The 45° beveled surface in the threaded female receiver 202 of the reducer 200 is connected to a straight section 210 that is the same length as the straight section 138 on the outlet end 108 of the funnel body 102 but is 0.020 inches larger in diameter. The straight section 210 of the reducer 200 is then connected to another 45° beveled surface that tightens against the bottom 45° beveled surface on the outlet end 108 of the funnel body 102. These two 45° beveled surfaces inside the reducer 200 then tighten against the beveled surfaces of the cap-reservoir 300 concurrently contact the two 45° beveled surfaces on the outside of the threaded male connector 206 of the reducer 200 to provide the seal between the reducer 200 and the cap-reservoir 300. The reservoir 304 of the cap-reservoir 300 is for collecting and storing remnant fluid remaining in the funnel body 102 after its use.

In an alternative embodiment, a valve can be attached to the cap-reservoir 300 and the reducer 200 to further restrict or open the flow of liquid. In another alternative embodiment, the 45° beveled surfaces can be removed and the components of the funnel 100 can contact each other by other comparable means to make a proper seal, e.g., via snap-on assemblies. The seal may also be made of materials other than rubber and may be used in different manners to accomplish the objective of sealing the funnel 100. Moreover, the position of the accessories, lid 110, and the support fin 118 are not limited to any specific side of the funnel body 102. All components of the funnel 100 are positioned to provide the most efficient body design. By way of example, the lid 110 may be pivotally connected to either side of the funnel body 102, depending on the design, or the lid 110 may be temporarily removable.

Figure 5:
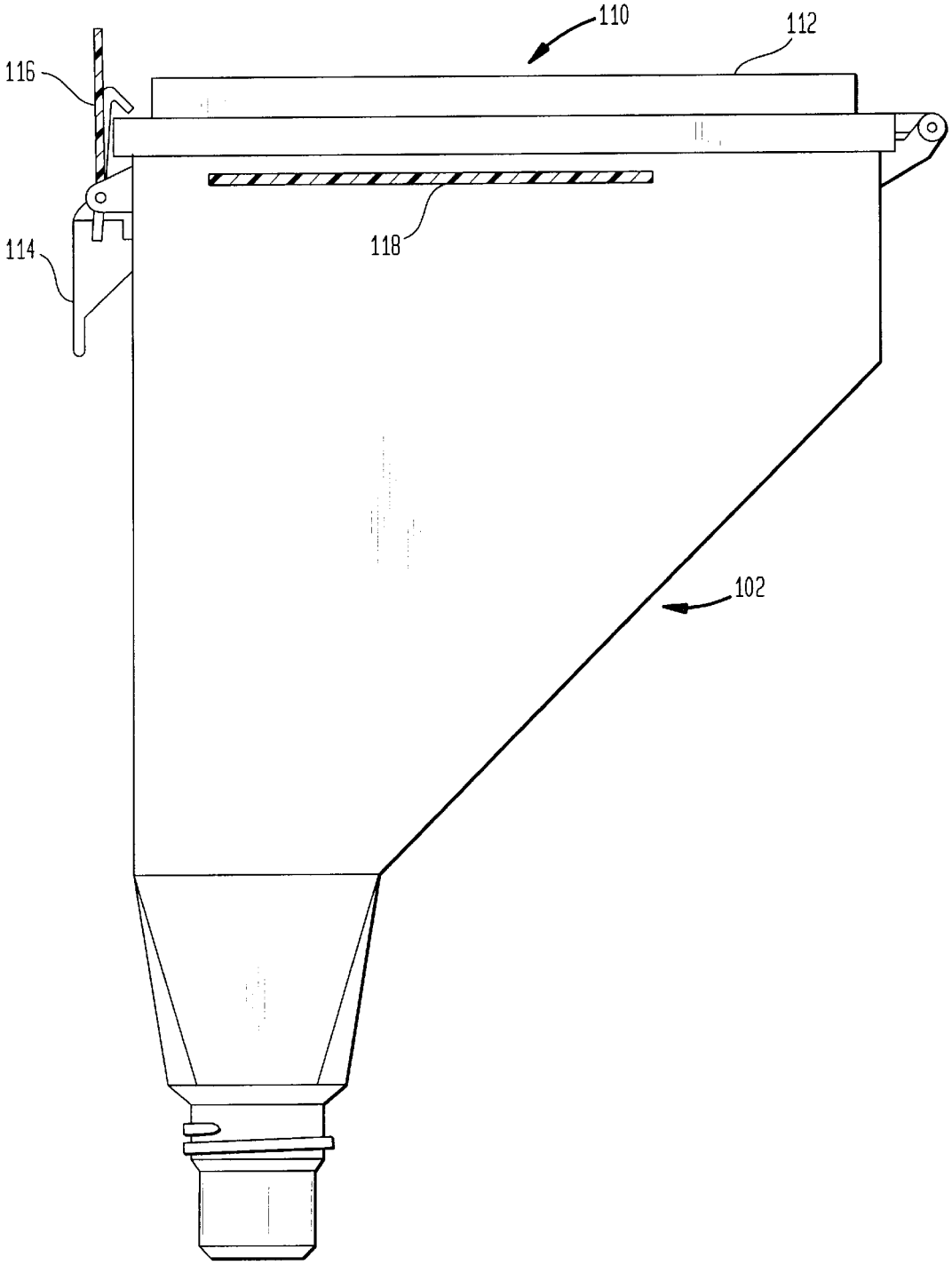
FIG. 5 is a planar view of the right side of the funnel.

FIG. 5 is a planar view of the right side of the funnel 100 and FIG. 6 is a planar view of the back of the funnel, wherein all previously described elements of the funnel 100 of the present invention are shown in relation to each other.

FIG. 7 is a cross sectional view of the preferred embodiment of the reducer 200 of the present invention showing the threaded female receiver 202, the threaded male connector 206, the outlet end 204 and the outlet end hole 208.

FIG. 8 is a cross sectional view of the preferred embodiment of the cap-reservoir 300 of the present invention showing the threaded female receiver 302 and the reservoir 304.

Figure 9:
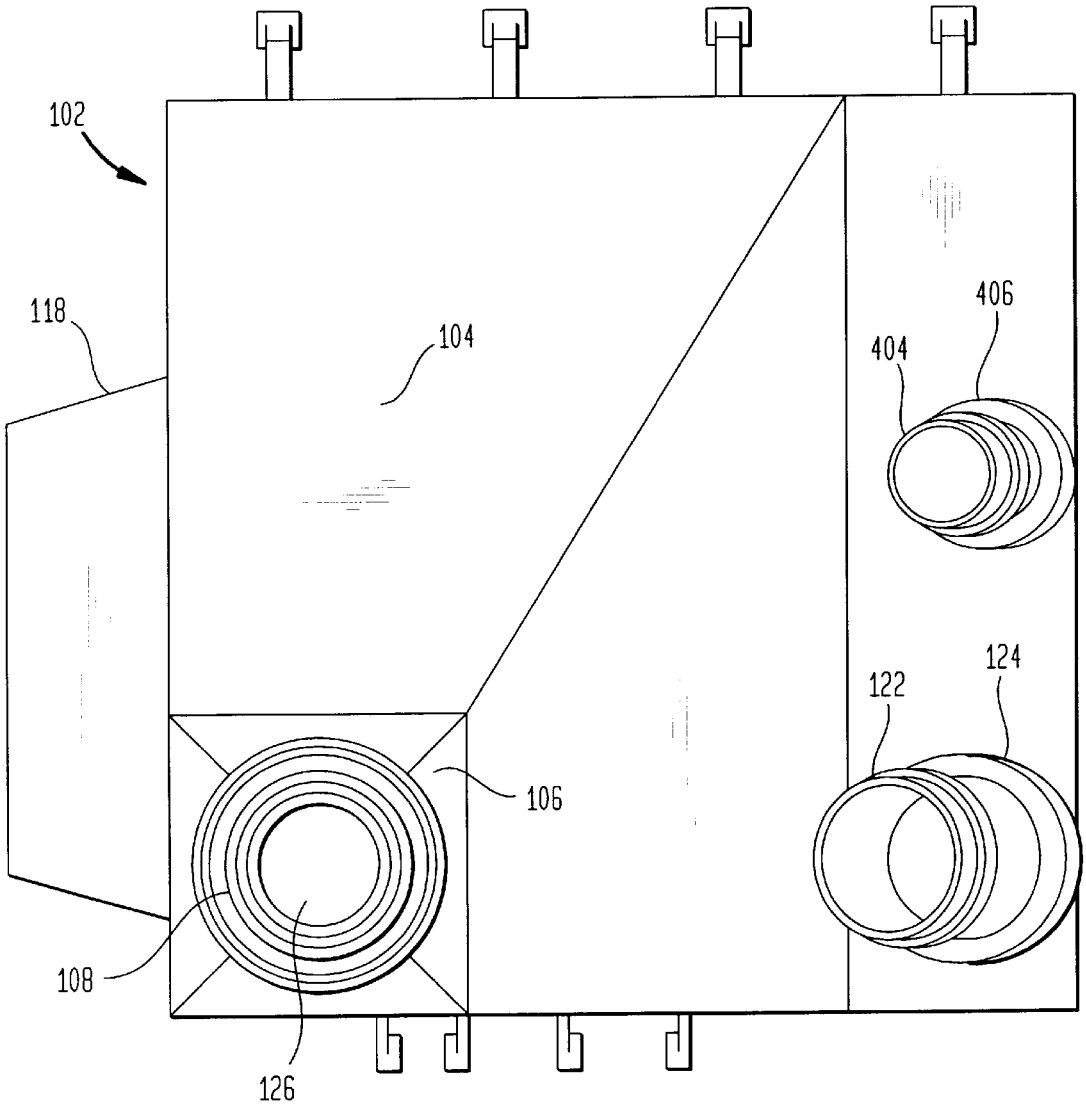
FIG. 9 is a planar bottom view of the funnel body.
Figure 10:
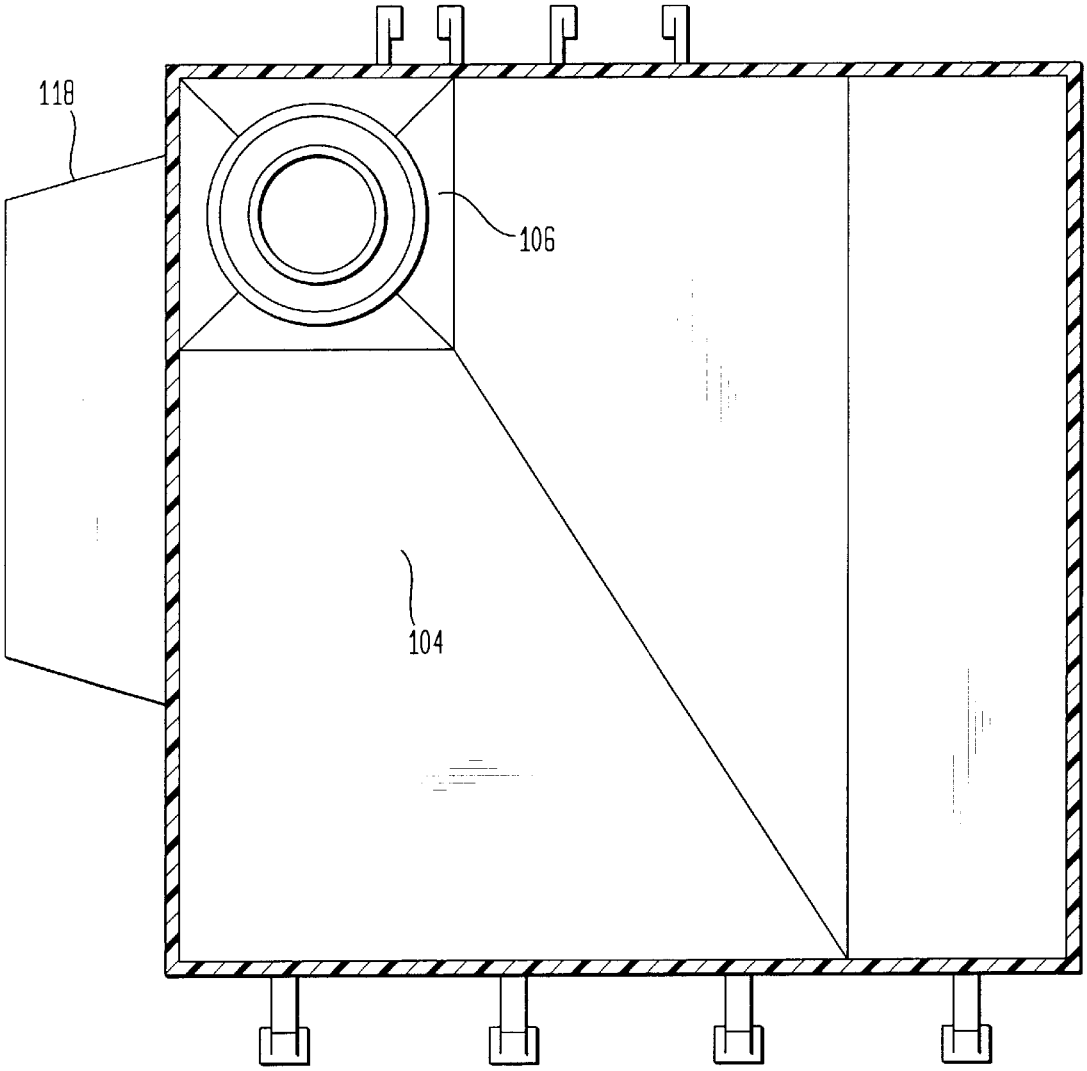
FIG. 10 is a planar top view of the funnel.

FIG. 9 is a planar bottom view of the funnel body 102 and FIG. 10 is a planar top view of the funnel body 102 showing the four sides of the preferred embodiment of the square shape of the inlet end 104. These viewpoints of the funnel 100 shows the funnel neck 106 and outlet end 108 of the funnel 100 being offset from a center axis of the funnel 100, wherein the outlet end 108 is in the bottom right corner of the funnel body 102. In alternative embodiments, the outlet end 108 may be positioned in any corner of the funnel body 102.

Figure 11A:
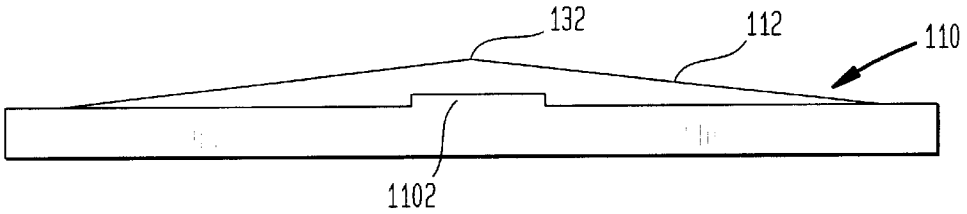
FIG. 11A is a planar front view of a lid for the funnel of the present invention.

FIGS. 11A–F are various planar views of a lid 110 of the present invention for the inlet end 104 of the funnel body 102 of the present invention. FIG. 11A is a planar front view of a lid 110 that FIG. 5 is a planar view of the right side of the funnel 100 and FIG. 6 is a planar view of the back of the funnel, wherein all previously described elements of the funnel 100 of the present invention are shown in relation to each other.

FIG. 7 is a cross sectional view of the preferred embodiment of the reducer 200 of the present invention showing the threaded female receiver 202, the threaded male connector 206, the outlet end 204 and the outlet end hole 208.

FIG. 8 is a cross sectional view of the preferred embodiment of the cap-reservoir 300 of the present invention showing the threaded female receiver 302 and the reservoir 304.

FIG. 9 is a planar bottom view of the funnel body 102 and FIG. 10 is a planar top view of the funnel body 102 showing the four sides of the preferred embodiment of the square shape of the inlet end 104. These viewpoints of the funnel 100 shows the funnel neck 106 and outlet end 108 of the funnel 100 being offset from a center axis of the funnel 100, wherein the outlet end 108 is in the bottom right corner of the funnel body 102. In alternative embodiments, the outlet end 108 may be positioned in any corner of the funnel body 102.

Figure 11B:
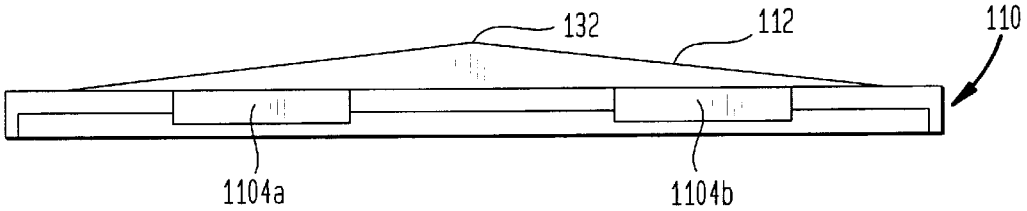
FIG. 11B is a planar back view of the lid.
Figure 11C:
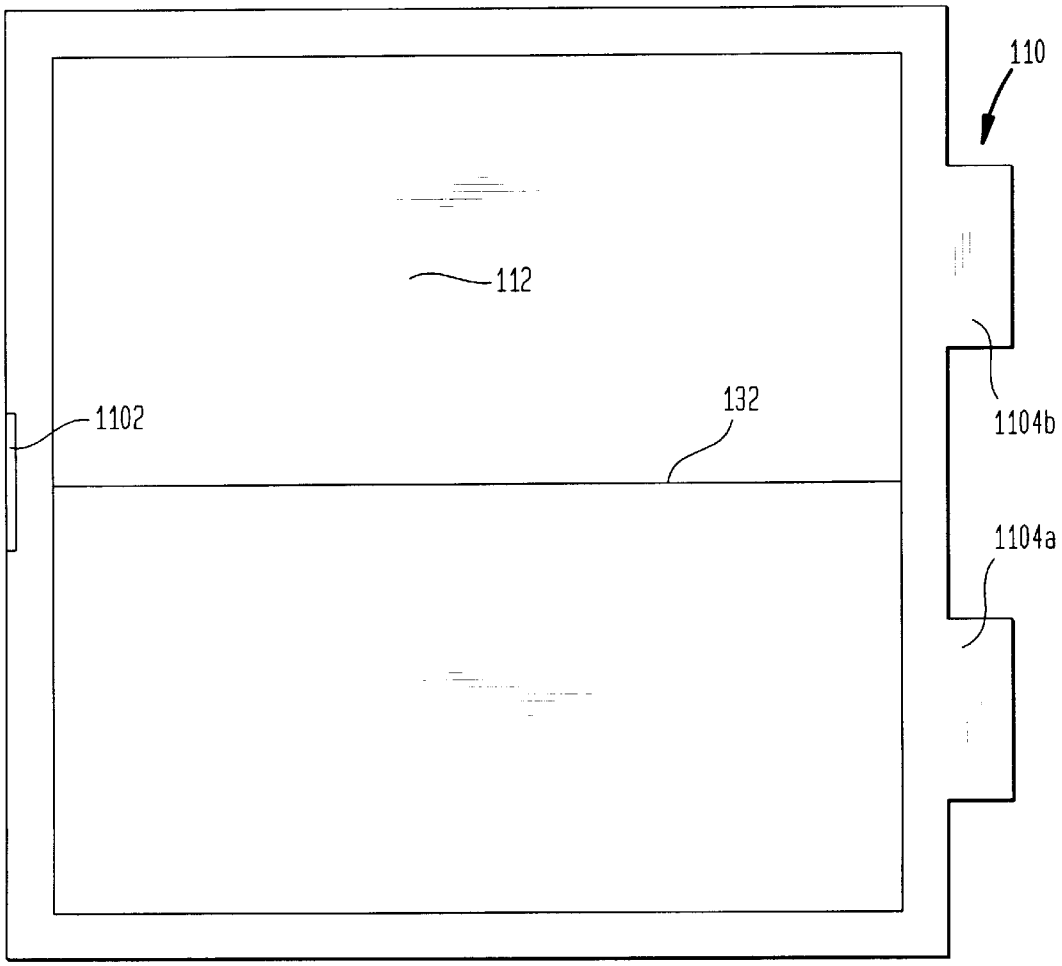
FIG. 11C is a planar top view of the lid.
Figure 11D:
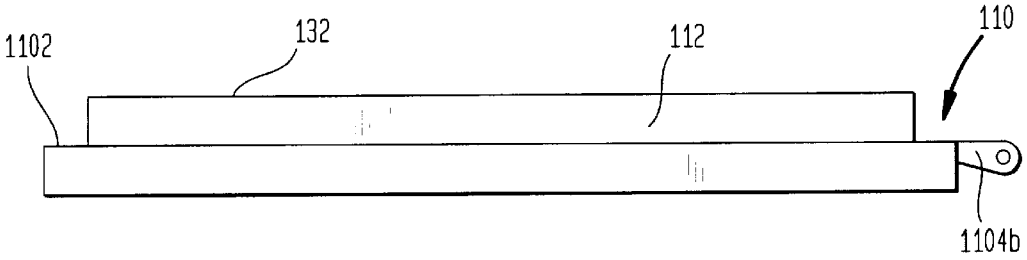
FIG. 11D is a planar side view of the lid.
Figure 11E:
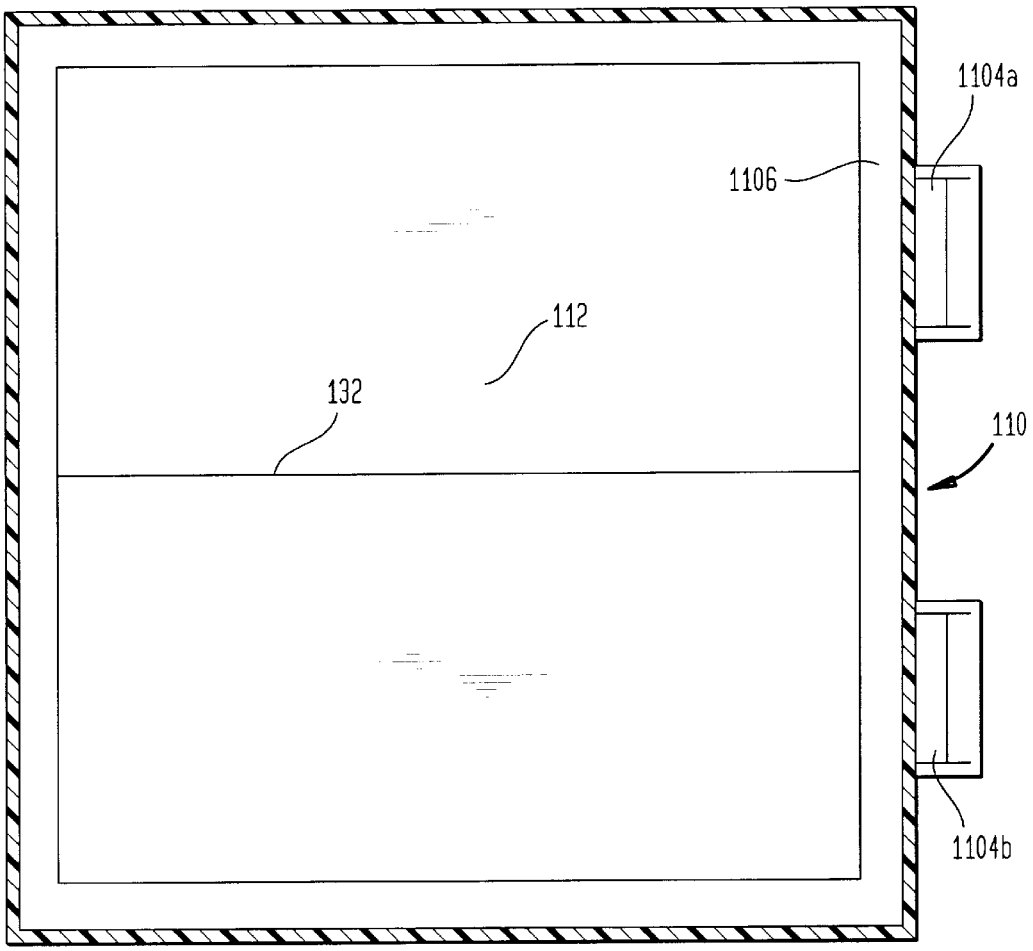
FIG. 11E is a planar bottom view of the lid showing a rubber seal.
Figure 11F:
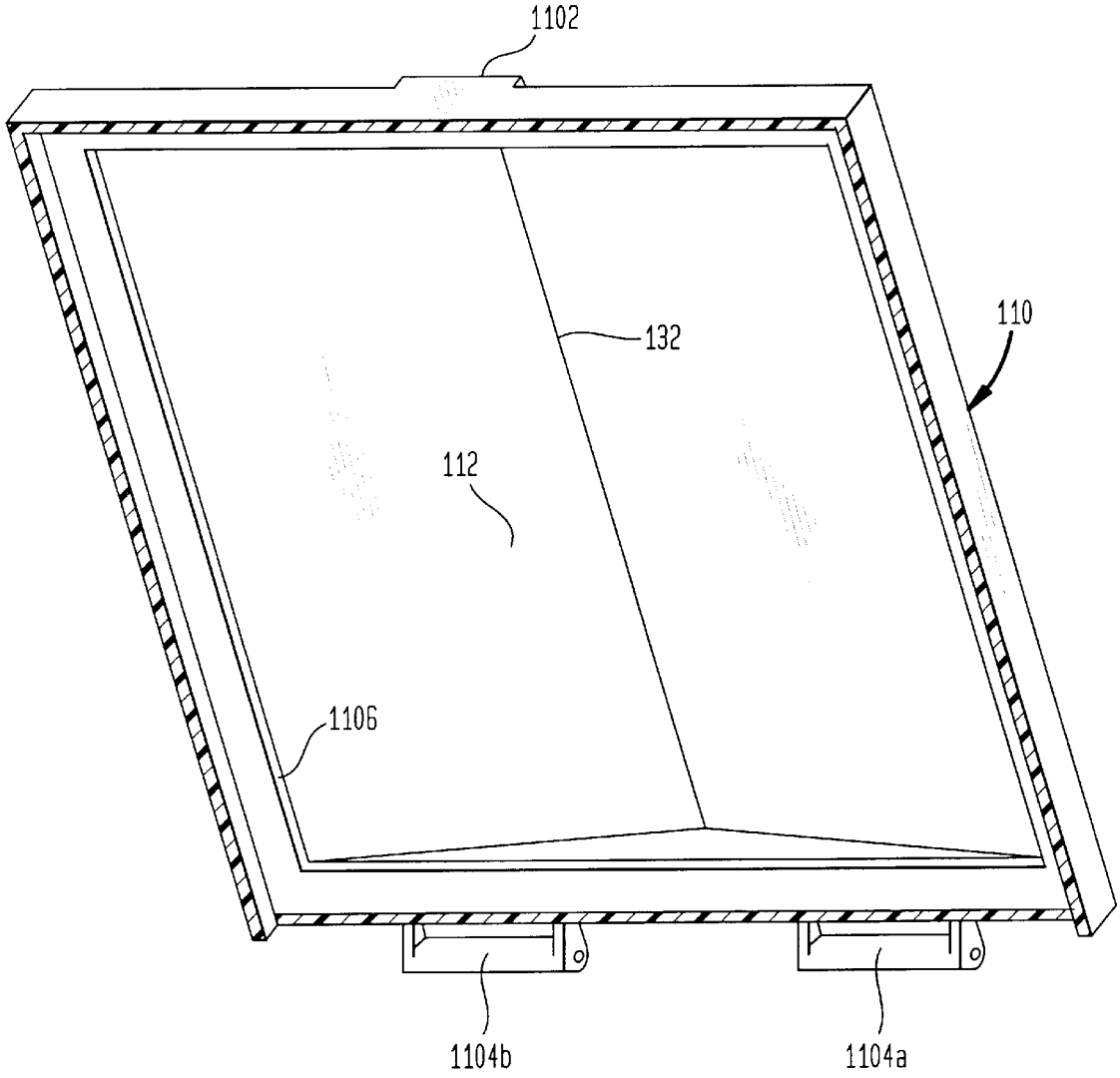
FIG. 11F is perspective bottom view of the lid showing the rubber seal.

FIGS. 11A–F are various planar views of a lid 110 of the present invention for the inlet end 104 of the funnel body 102 of the present invention. FIG. 11A is a planar front view of a lid 110 that shows the peak 132 of the top section 112 as described above. In addition, a raised portion 1102 is shown that is used in conjunction with the latch catch 114 for securing the lid 110 on the funnel body 102. FIG. 11B is a planar back view of the lid 110 which shows a first hinge 1104*a* and a second hinge 1104*b* for pivotally connecting the lid 110 to the funnel body 102. FIG. 11C is a planar top view of the lid 110. FIG. 11D is a planar side view of the lid 110. FIG. 11E is a planar bottom view of the lid 110 showing a seal 1106, preferably rubber, used to ensure a tight fit of the lid 110 and to completely close off the inlet end 104 of the funnel body 102. FIG. 11F is perspective bottom view of the lid 110 showing the seal 1106.

Figure 12A:
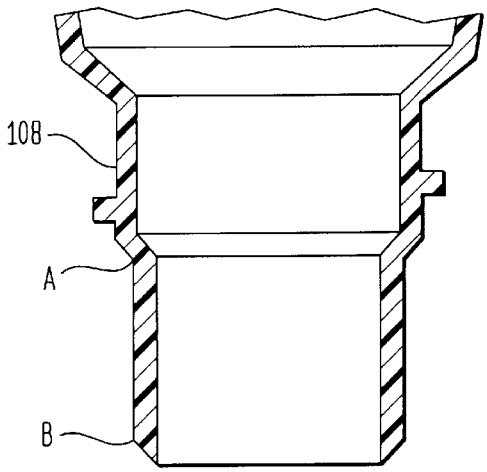
FIG. 12A is an enlargement of a cross sectional view of the outlet end of the funnel showing its relationship to the inlet end of the reducer.
Figure 12B:
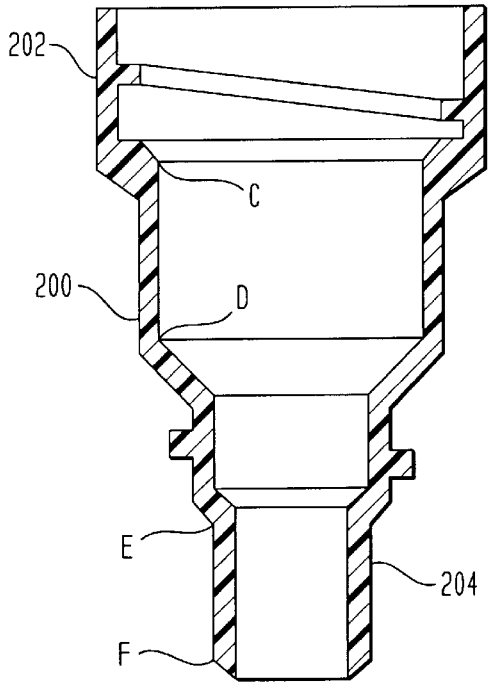
FIG. 12B is an enlargement of a cross sectional view of the reducer showing the relationship between the inlet end to the outlet end of the funnel and the relationship between the outlet end to the inlet end of the cap-reservoir.
Figure 12C:
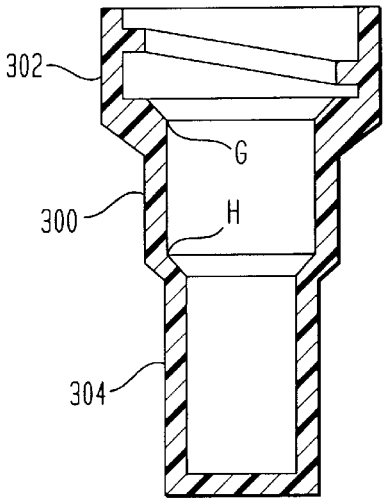
FIG. 12C is an enlargement of a cross sectional view of the cap-reservoir showing the relationship of the inlet end of the cap-reservoir to the outlet end of the cap-reservoir.
Figure 13:
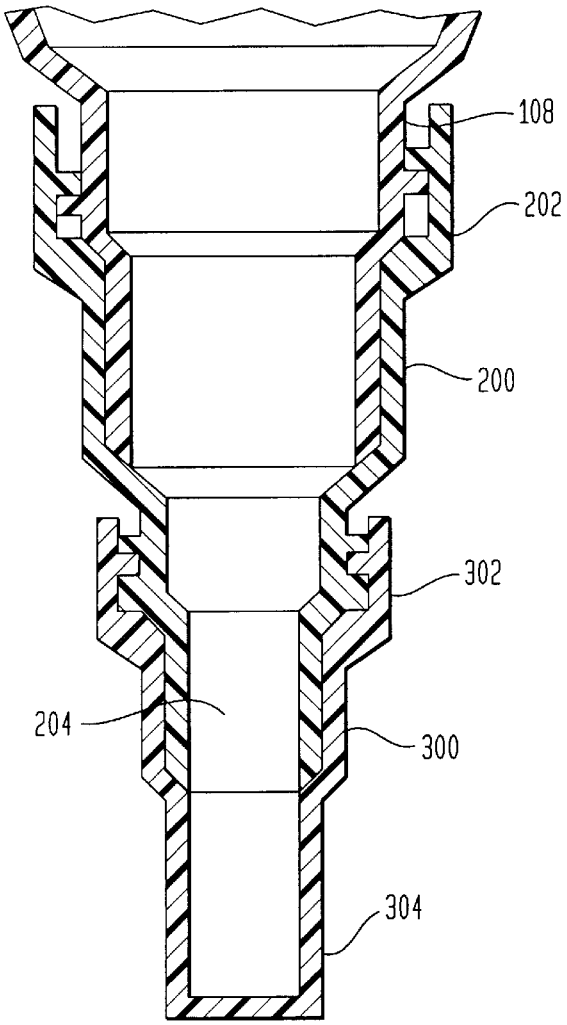
FIG. 13 is an enlargement showing a cross sectional view of the cap-reservoir, reducer, and funnel outlet screwed together.
Figure 14:
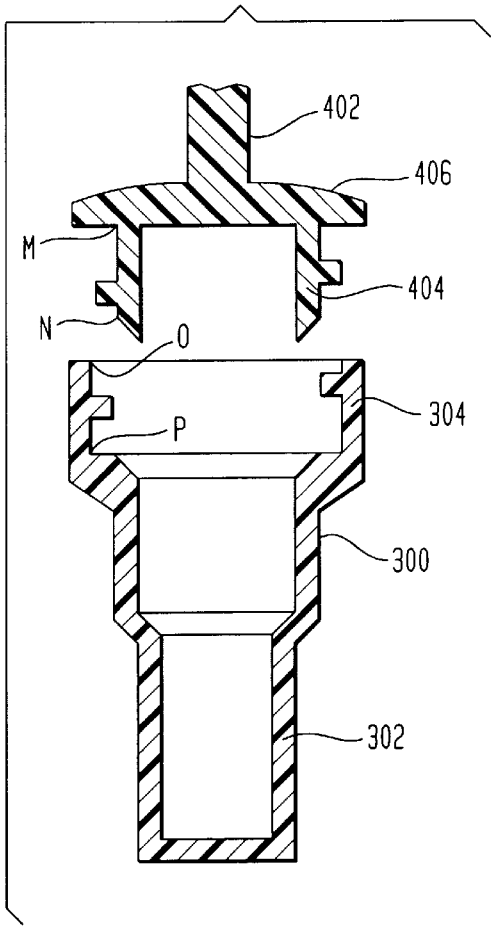
FIG. 14 is an enlargement of a cross sectional view of the cap-reservoir receptacle and the inlet end of the cap-reservoir.
Figure 15A:
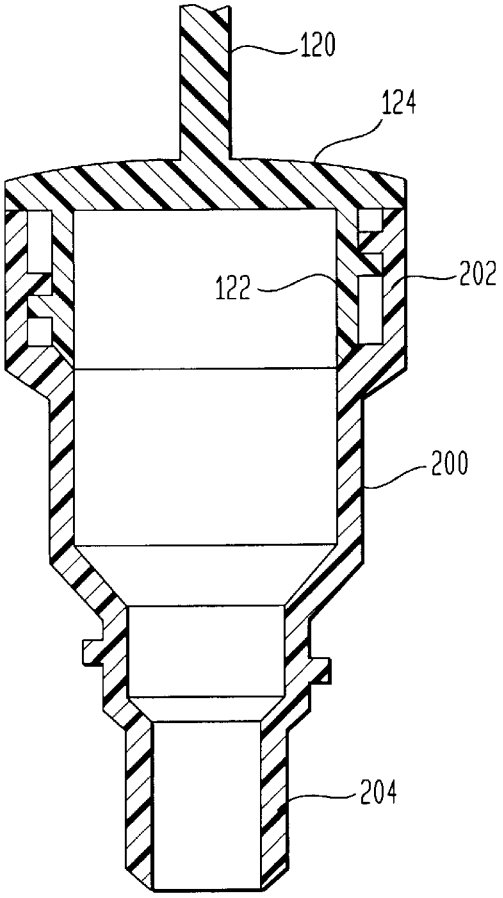
FIG. 15A is an enlargement of a cross sectional view of the reducer screwed to the reducer receptacle.
Figure 15B:
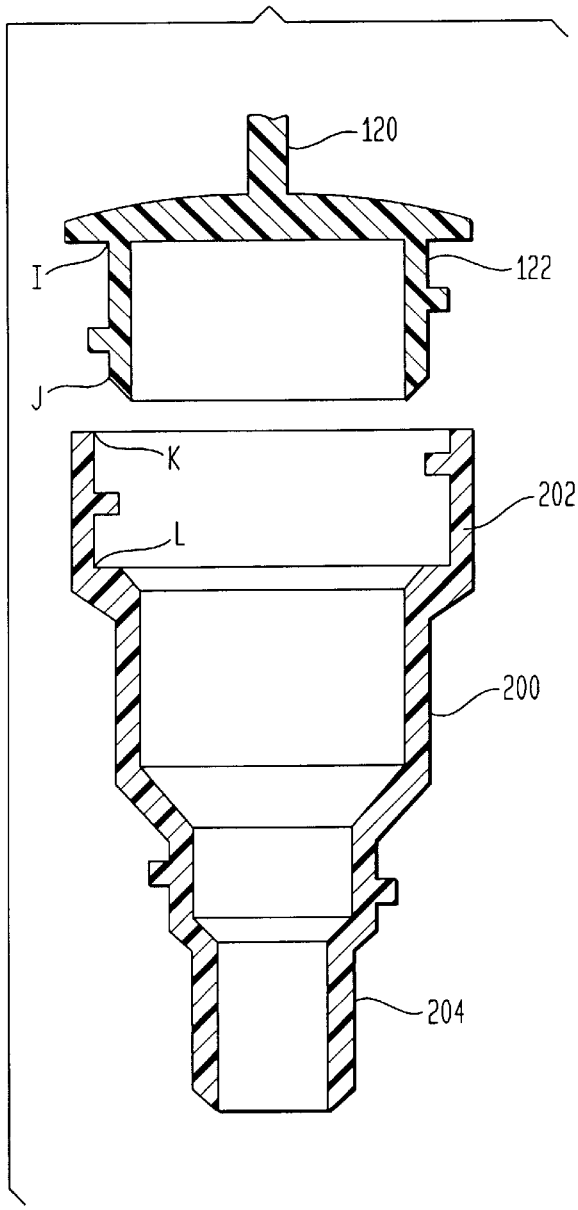
FIG. 15B is an enlargement of a cross sectional view of the reducer receptacle and the inlet end of the reducer.

FIGS. 12A–C are cross sectional views illustrating the preferred embodiment of how the outlet end 108 of the funnel body 102 uses the removably attachable accessories, e.g., the reducer 200 and cap-reservoir 300. FIG. 12A shows the outlet end 108 of the funnel body 102 in relation to the threaded female receiver 202 of the reducer 200 as shown directly below in FIG. 12B. FIG. 12C shows the cap-reservoir 300 in greater detail. FIG. 13 is an enlargement showing a cross sectional view of the cap-reservoir 300, reducer 200, and outlet end 108 of the funnel body screwed together according to the preferred embodiment, wherein FIG. 14 is an enlargement of a cross sectional view of the interconnection between the cap-reservoir receptacle 404 and the threaded female receiver 302 of the cap-reservoir 300. FIG. 15A is an enlargement of a cross sectional view of the reducer 200 screwed to the reducer receptacle 122, and FIG. 15B is an enlargement of a cross sectional view of the reducer receptacle 122 and the threaded female receiver 202 of the reducer 200.

Figure 16A:
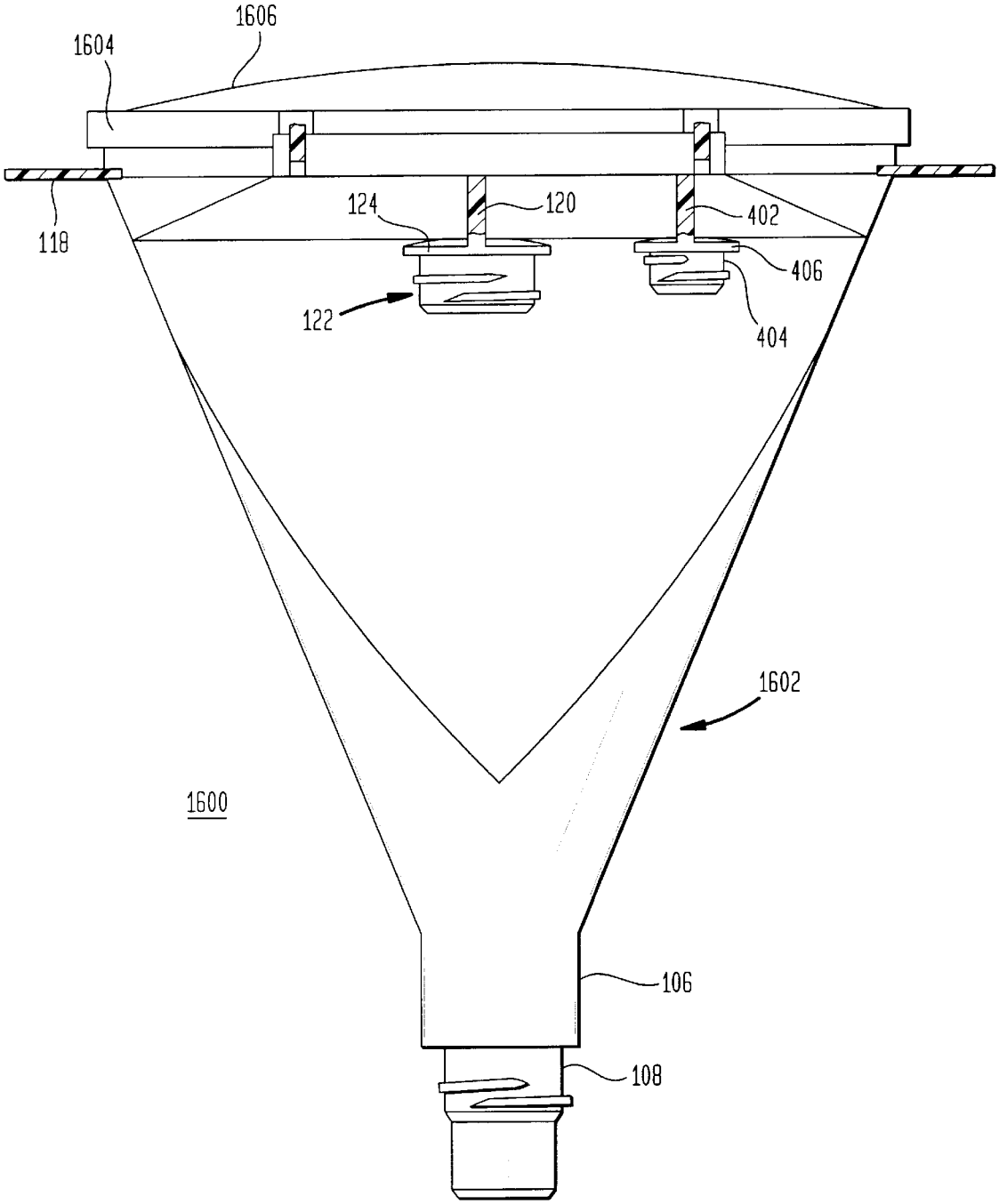
FIG. 16A is a planar side view of the left side of an alternative embodiment of a funnel of the present invention having a round inlet end.
Figure 16B:
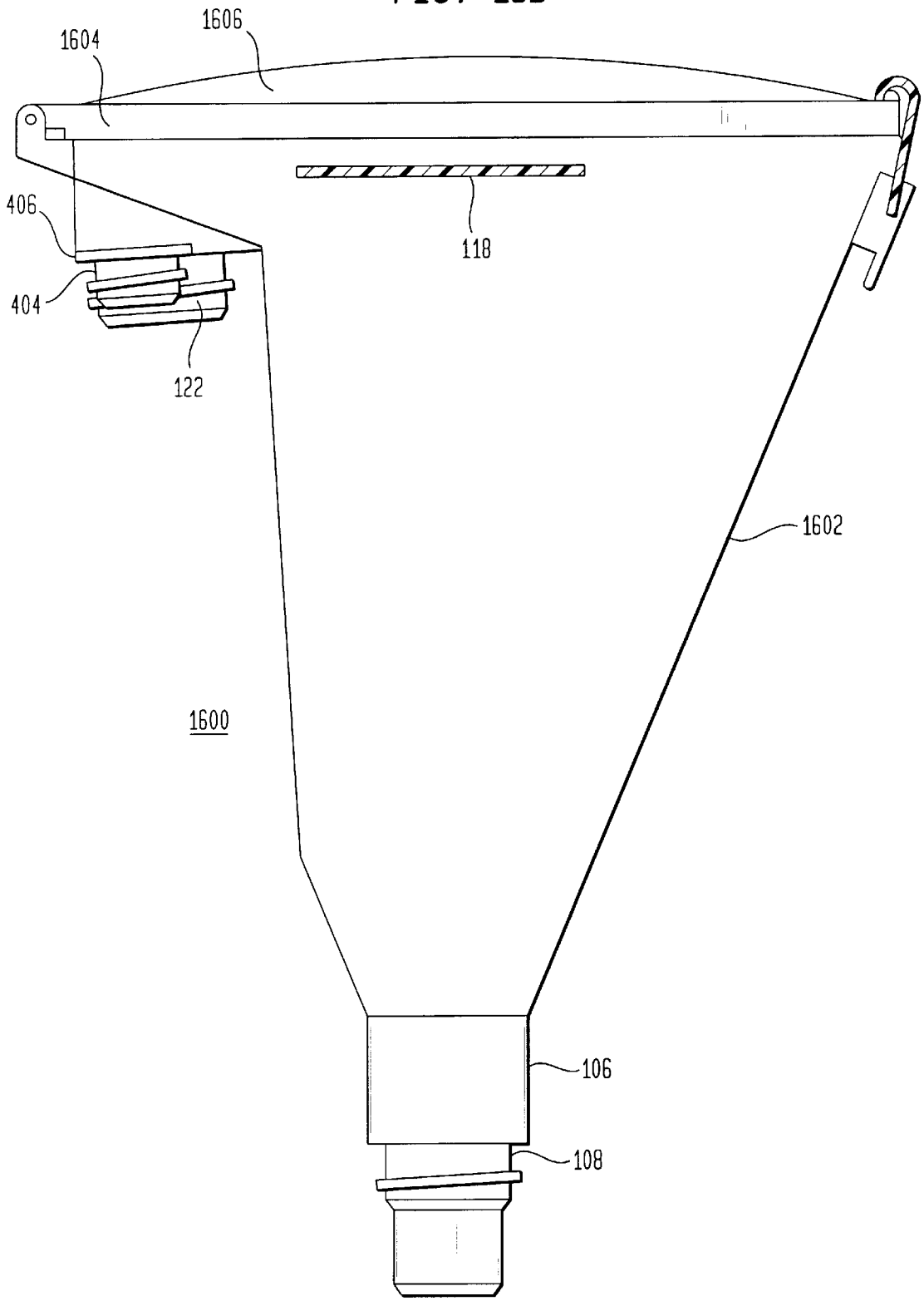
FIG. 16B is a planar back view of the alternative embodiment of a funnel having a round inlet end.

FIGS. 16A, B are planar side views of an alternative embodiment of a funnel of the present invention where in the funnel body 1602 has a round shape as compared to the square shape of the preferred embodiment of the funnel body 102. All other features of the funnel 100 of the present invention are similar in this alternative embodiment.

The preferred embodiment of the present invention is made of a hard, durable plastic. Furthermore, it should be understood that enough detail has been provided such that a person of ordinary skill in the relevant art(s) would be able to design and manufacture a funnel 100 of the present invention. In addition, the use of dimensions has been for convenience purpose only. It would be readily apparent for one of ordinary skill in the relevant art(s) to design and manufacture a funnel 100 having different dimensions.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A funnel, comprising:

a funnel body having an inlet end, an outlet end, and a neck connecting the inlet end and the outlet end;

a lid for covering said funnel body, wherein said lid is permanently and pivotally connected to said funnel body;

at least one accessory adapted to be removably attachable to the outlet end of said funnel body;

at least one receptacle located on the exterior of said funnel body for receiving and storing said at least one accessory to said funnel body; and a means for removably attaching said at least one accessory to the outlet end of said funnel body.

2. The funnel according to claim 1, wherein one said accessory is a reducer having a top end removably attachable to the outlet end of said funnel body and a bottom end the bottom end having a smaller diameter than the top end.

3. The funnel according to claim 2, further comprising a second accessory wherein said second accessory is a cap-reservoir having a top end and bottom end being a closed off reservoir such that the top end of said cap-reservoir is removably attachable to the bottom end of said reducer.

4. The funnel according to claim 3, wherein the outlet end of said funnel has a threaded male connector, the top end of said reducer is a threaded female receiver, the bottom end of said reducer is a threaded male connector, the top end of said cap-reservoir is a threaded female receiver.

5. The funnel according to claim 2 wherein said reducer further comprises a valve for restricting flow through said reducer.

6. The funnel according to claim 1, wherein one said accessory is a cap-reservoir having a top end removably attachable to the outlet end of said funnel body and a bottom end being a closed off reservoir.

7. The funnel according to claim 1, wherein the inlet end of said funnel body is square in shape having four sides: a front, back, right side and left side.

8. The funnel according to claim 7, wherein the outlet end is offset to one side of said funnel body.

9. The funnel according to claim 8, wherein the outlet end is positioned in a corner of said funnel body.

10. The funnel according to claim 1, further comprising:

a support fin positioned on the exterior of said funnel body in proximity to the inlet end of said funnel body.

11. The funnel according to claim 1, further comprising:

a hanger clip pivotally attached to the exterior of said inlet end of said funnel body.

12. The funnel according to claim 1, wherein said means for removably attaching said at least one accessory comprises the outlet end of said funnel body having a threaded male connector and said at least one accessories having a threaded female receiver.

13. The funnel according to claim 1, wherein the top of said removably attachable lid has a peak.

14. The funnel according to claim 1, wherein said removably attachable lid further comprises a seal for sealing said inlet end of said funnel body.

15. The funnel according to claim 14, wherein said seal is made of a latex material.

16. The funnel according to claim 1, wherein said at least one receptacle comprises a threaded male connector and said at least one accessory has a threaded female connector.

17. The funnel according to claim 1, wherein said means for removably attaching said at least one accessory to the outlet end of said funnel body, said at least one receptacle, and said at least one accessory comprise a snap-on mechanism.

* * * * *